US009664470B2

(12) United States Patent
No

(10) Patent No.: US 9,664,470 B2
(45) Date of Patent: May 30, 2017

(54) DRUM-TYPE MAGAZINE

(71) Applicants: Tae Jong No, Gwangmyeong-si (KR); KYUNGCHANG INDUSTRIAL CO., LTD., Paju-si (KR)

(72) Inventor: Tae Jong No, Gwangmyeong-si (KR)

(73) Assignee: KCI CO., LTD., Gyeonggi-Do (KR)

( * ) Notice: Subject to any disclaimer, the term of this patent is extended or adjusted under 35 U.S.C. 154(b) by 298 days.

(21) Appl. No.: 14/421,549

(22) PCT Filed: Jun. 13, 2013

(86) PCT No.: PCT/KR2013/005211

§ 371 (c)(1),
(2) Date: Feb. 13, 2015

(87) PCT Pub. No.: WO2014/035032

PCT Pub. Date: Mar. 6, 2014

(65) Prior Publication Data

US 2015/0219414 A1 Aug. 6, 2015

(30) Foreign Application Priority Data

Aug. 31, 2012 (KR) ..... 10-2012-0096362

(51) Int. Cl.
*F41A 9/75* (2006.01)

(52) U.S. Cl.
CPC ..... *F41A 9/75* (2013.01)

(58) Field of Classification Search
CPC ..... F41B 11/54; F41A 9/75
See application file for complete search history.

(56) References Cited

U.S. PATENT DOCUMENTS 118,916 A * 9/1871 Elliot ..... F41A 9/65 42/50
1,118,279 A * 11/1914 Elliot ..... A01C 7/06 111/73
2,064,888 A * 12/1936 Dickinson ..... F41A 9/75 124/52

(Continued)

FOREIGN PATENT DOCUMENTS

KR 1019870001687 9/1987
KR 1019910003038 5/1991

OTHER PUBLICATIONS

International Search Report—PCT/KR2013/005211 dated Oct. 21, 2013.

*Primary Examiner* — Troy Chambers
*Assistant Examiner* — Bridget Cochran
(74) *Attorney, Agent, or Firm* — Cantor Colburn LLP

(57) ABSTRACT

A drum-type magazine in which a cartridge loading space for being loaded with cartridges can be formed in a drum unit when rotating a cartridge guide unit by an operation of a cartridge loading unit, and the cartridge loading unit can be immediately returned to an initial position thereof, so a user can easily load the magazine with cartridges using a small force. The drum-type magazine is also configured such that, even when the magazine is repeatedly used over a lengthy period of time and the elasticity of a tension member is reduced, the elasticity of the tension member can be increased by rotating a tension control unit, so the magazine can be efficiently loaded with cartridges and can efficiently support the loaded cartridges.

8 Claims, 11 Drawing Sheets

(56) References Cited

U.S. PATENT DOCUMENTS

| | | | | |
|---|---|---|---|---|
| 2,321,720 | A * | 6/1943 | Whittaker | F41A 9/73<br>42/50 |
| 3,974,738 | A * | 8/1976 | Meyer | F41A 9/74<br>89/34 |
| 4,658,700 | A * | 4/1987 | Sullivan | F41A 9/73<br>89/33.02 |
| 7,942,091 | B2 * | 5/2011 | Winge | F41A 9/02<br>89/33.02 |
| 8,220,377 | B2 * | 7/2012 | Quetschke | F41A 9/75<br>42/49.01 |
| 8,448,558 | B2 * | 5/2013 | Lasichak | F41A 9/03<br>42/49.01 |
| 8,733,224 | B2 * | 5/2014 | Lasichak | F41A 9/70<br>42/49.01 |
| 2010/0147277 | A1 * | 6/2010 | Zimmerman | F41A 9/25<br>124/56 |
| 2011/0107901 | A1 * | 5/2011 | Lasichak | F41A 9/03<br>89/33.02 |

* cited by examiner

DRUM-TYPE MAGAZINE

TECHNICAL FIELD

The present invention generally relates to a drum-type magazine. More particularly, the present invention relates to a drum-type magazine in which a cartridge loading space for being loaded with cartridges can be formed in a drum unit when rotating a cartridge guide unit by an operation of a cartridge loading unit, and the cartridge loading unit can be immediately returned to an initial position thereof, so a user can easily load the magazine with cartridges using a small force and can control the elasticity of a tension member by rotating a tension control unit.

BACKGROUND ART

In general, a magazine is a receptacle that is loaded with a number of cartridges, such as ball cartridges or blank cartridges. A loaded magazine may be inserted into a rifle or may be carried by a user.

In the related art, a box-type magazine in which cartridges are loaded in a straight line and a drum-type magazine in which cartridges are loaded in a cylindrical drum in a spiral line are well-known.

An example of related art drum-type magazines may be referred to Korean Patent Publication No. 10-1988-0700238 (10-1991-0003038) entitled 'Drum Magazine'.

The drum magazine disclosed in the publication is problematic in that, to load the magazine with a number of cartridges, a user should sequentially insert the cartridges into a cylindrical drum of the magazine one by one with a strong force, so the user feels inconvenience when loading the magazine. Further, the loaded cartridges may become jammed in the cylindrical drum of the magazine, so the cartridge loading efficiency of the magazine may be reduced.

Another problem of the drum magazine disclosed in the publication resides in that, when the magazine is repeatedly used over a lengthy period of time, the elasticity of a tension member of the magazine that functions to support loaded cartridges may be reduced. When the elasticity of the tension member is reduced, the tension member may fail to efficiently support cartridges in the magazine and may fail to precisely feed the cartridges into a cartridge chamber of a rifle, thereby causing a failure in firing.

DISCLOSURE

Technical Problem

Accordingly, the present invention has been made keeping in mind the above problems occurring in the related art, and the present invention is intended to propose a drum-type magazine in which a cartridge loading space for being loaded with cartridges can be formed in a drum unit when rotating a cartridge guide unit by an operation of a cartridge loading unit, and the cartridge loading unit can be immediately returned to an initial position thereof, so a user can easily load the magazine with cartridges using a small force.

The present invention is also intended to propose a drum-type magazine in which, even when the magazine is repeatedly used over a lengthy period of time and the elasticity of a tension member is reduced, the elasticity of the tension member can be increased by rotating a tension control unit, so the magazine can be efficiently loaded with cartridges and can efficiently support the loaded cartridges.

Technical Solution

In order to achieve the above object, according to one aspect of the present invention, there is provided a drum-type magazine, including:

a drum unit having a space therein for being loaded with cartridges in a spiral line;

a plurality of imitation cartridges installed in the drum unit;

a cartridge guide unit combined with the drum unit and guiding the loading of cartridges while being rotated by an operation of a tension control unit;

a tension member mounted to an outer surface of the drum unit and elastically supporting the cartridge guide unit;

the tension control unit controlling elasticity of the tension member;

a cartridge loading unit mounted to the outer surface of the drum unit and rotating the cartridge guide unit by an operation of a cartridge loading lever, thereby forming a cartridge loading space in the drum unit for being loaded with cartridges, wherein the cartridge loading lever is immediately returned to an initial position thereof by a second spring; and a protective cover unit mounted to the outer surface of the drum unit and protecting both the tension control unit and the cartridge loading unit.

Advantageous Effects

The drum-type magazine of the present invention is advantageous in that the cartridge loading space for being loaded with cartridges can be formed in the drum unit when rotating the cartridge guide unit by an operation of the cartridge loading unit, and the cartridge loading unit can be immediately returned to an initial position thereof, so a user can easily load the magazine with cartridges using a small force.

Another advantage of the present invention resides in that, even when the drum-type magazine is repeatedly used over a lengthy period of time and the elasticity of the tension member is reduced, the elasticity of the tension member can be increased by rotating the tension control unit, so the magazine can be efficiently loaded with cartridges and can efficiently hold cartridges loaded therein.

Figure 1:
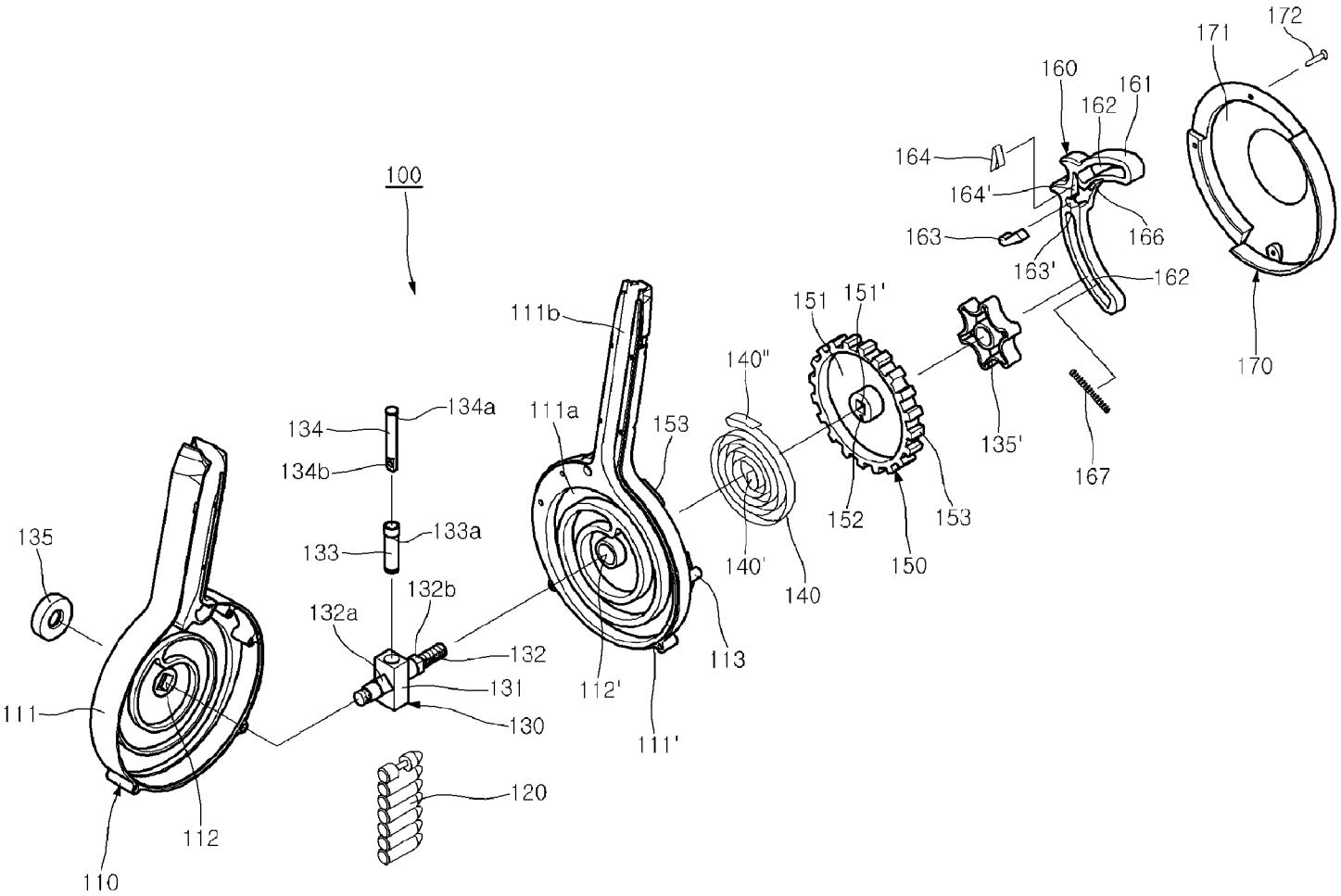
FIG. 1 is an exploded perspective view of a drum-type magazine of the present invention.

<Description of the Reference Numerals in the Drawings>

| | |
|---|---|
| 100: drum-type magazine | 110: drum unit |
| 111: first casing | 111': second casing |
| 112, 112': locking through holes | |

-continued

| <Description of the Reference Numerals in the Drawings> | |
|---|---|
| 113: guide protrusions | |
| 120: imitation cartridges | 130: cartridge guide unit |
| 131: main body | 132: locking shaft |
| 133: guide member | 134: holding member |
| 140: tension member | 150: tension control unit |
| 151: toothed body | 152: locking slit |
| 153: rib | 154: teeth |
| 160: cartridge loading unit | |
| 161: cartridge loading lever | |
| 162: longitudinal guide holes | |
| 163: rotation piece | 164: first spring |
| 165: forcible rotating protrusion | |
| 166: guide recess | 167: second spring |
| 170: protective cover unit | |
| 171: cover | 172: fastening member |

MODE FOR INVENTION

Figure 2:
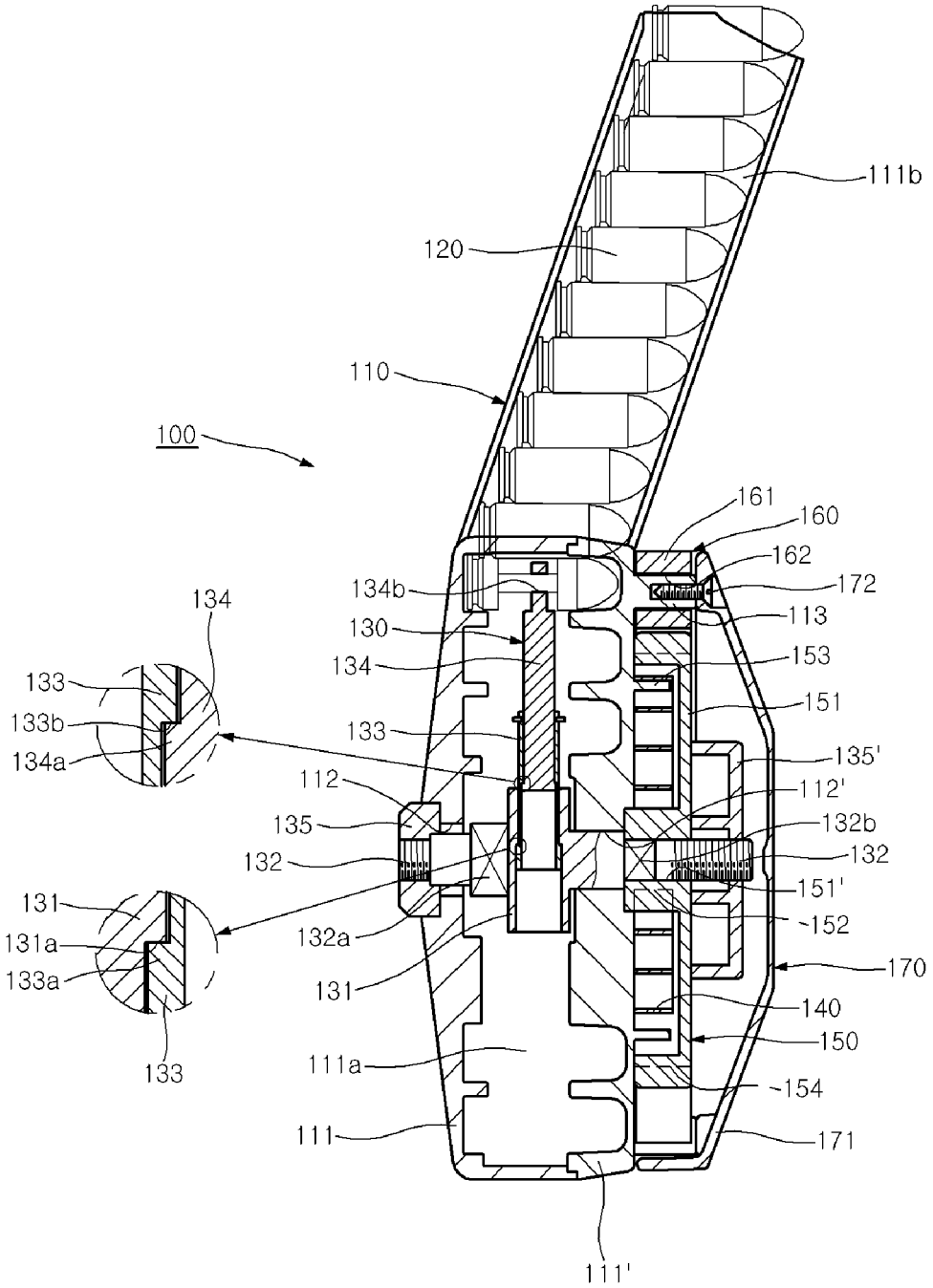
FIG. 2 is a sectional view of the drum-type magazine of the present invention.
Figure 3:
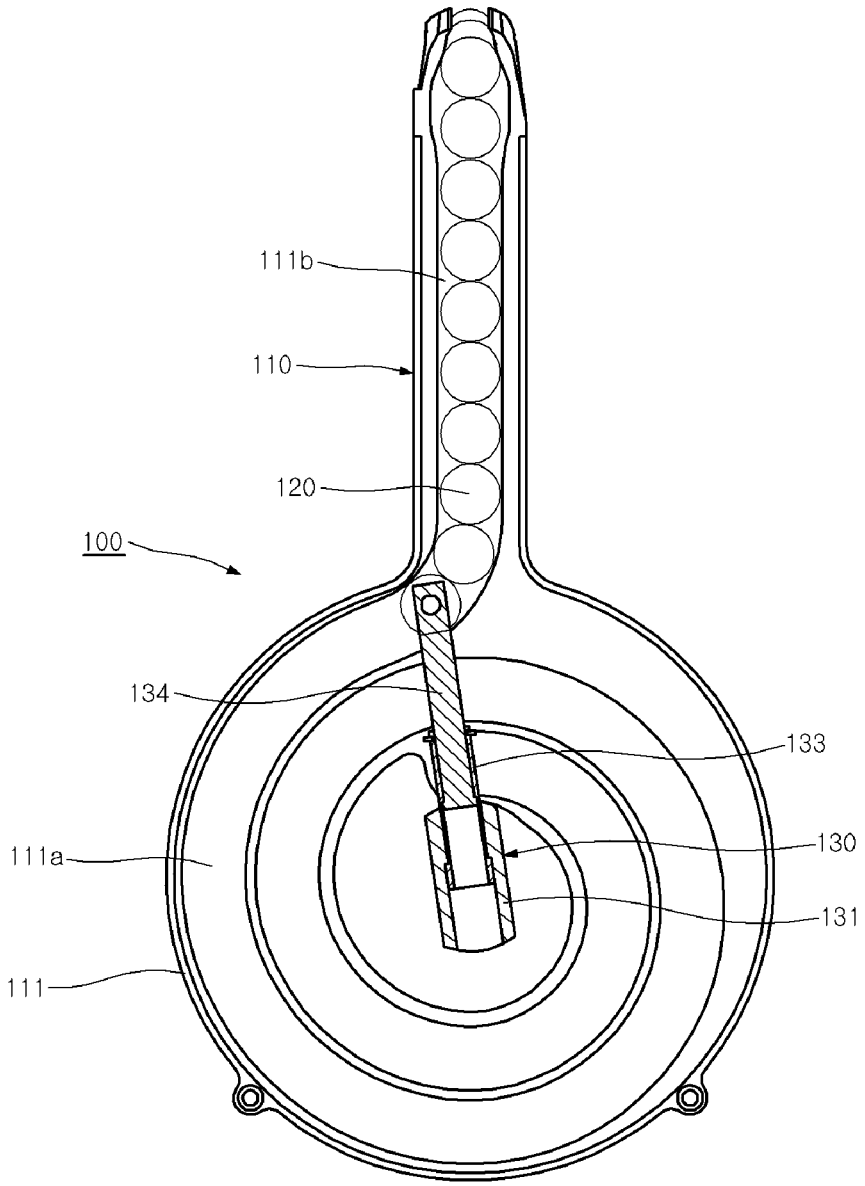
FIG. 3 is a view showing the internal structure of the drum-type magazine of the present invention.
Figure 4:
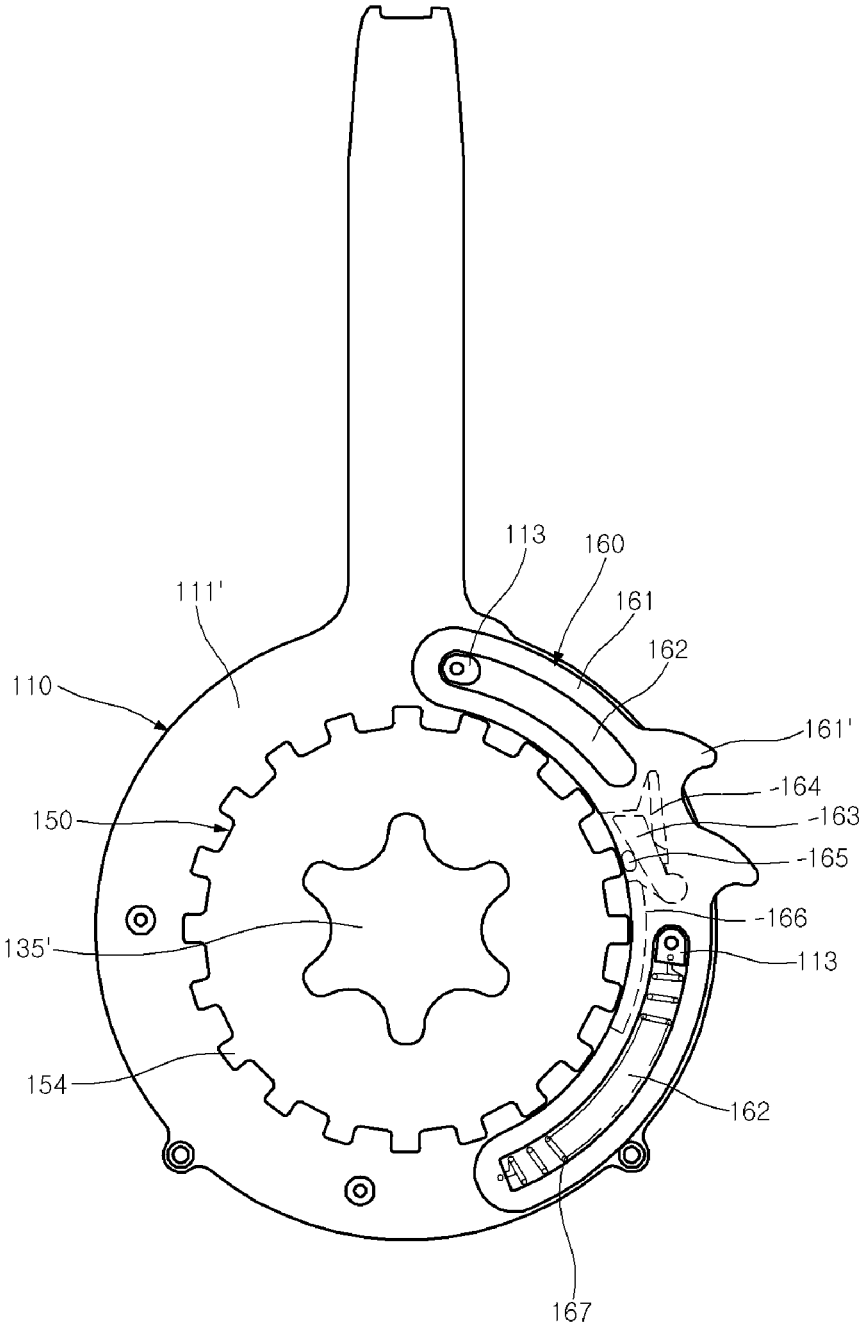
FIG. 4 is a view showing the rear structure of the drum-type magazine of the present invention.
Figure 5:
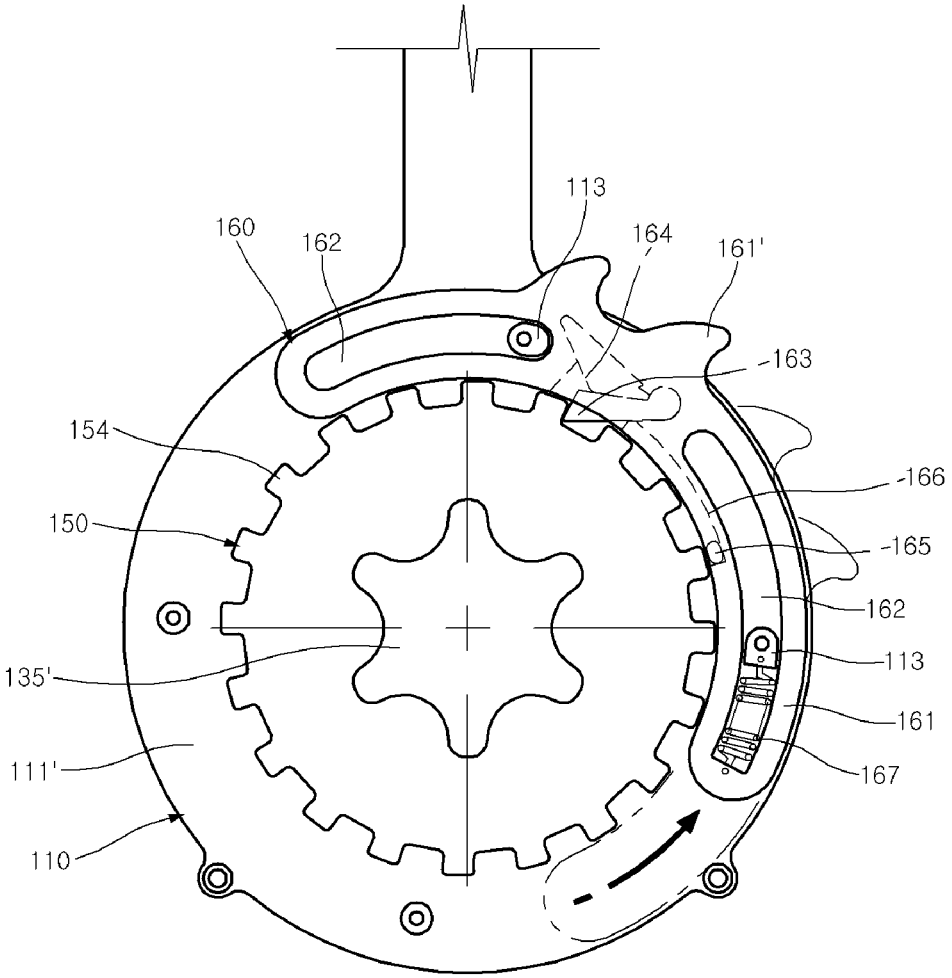
FIGS. 5 to 8 are views showing a process of loading the drum-type magazine of the present invention with cartridges.
Figure 6:
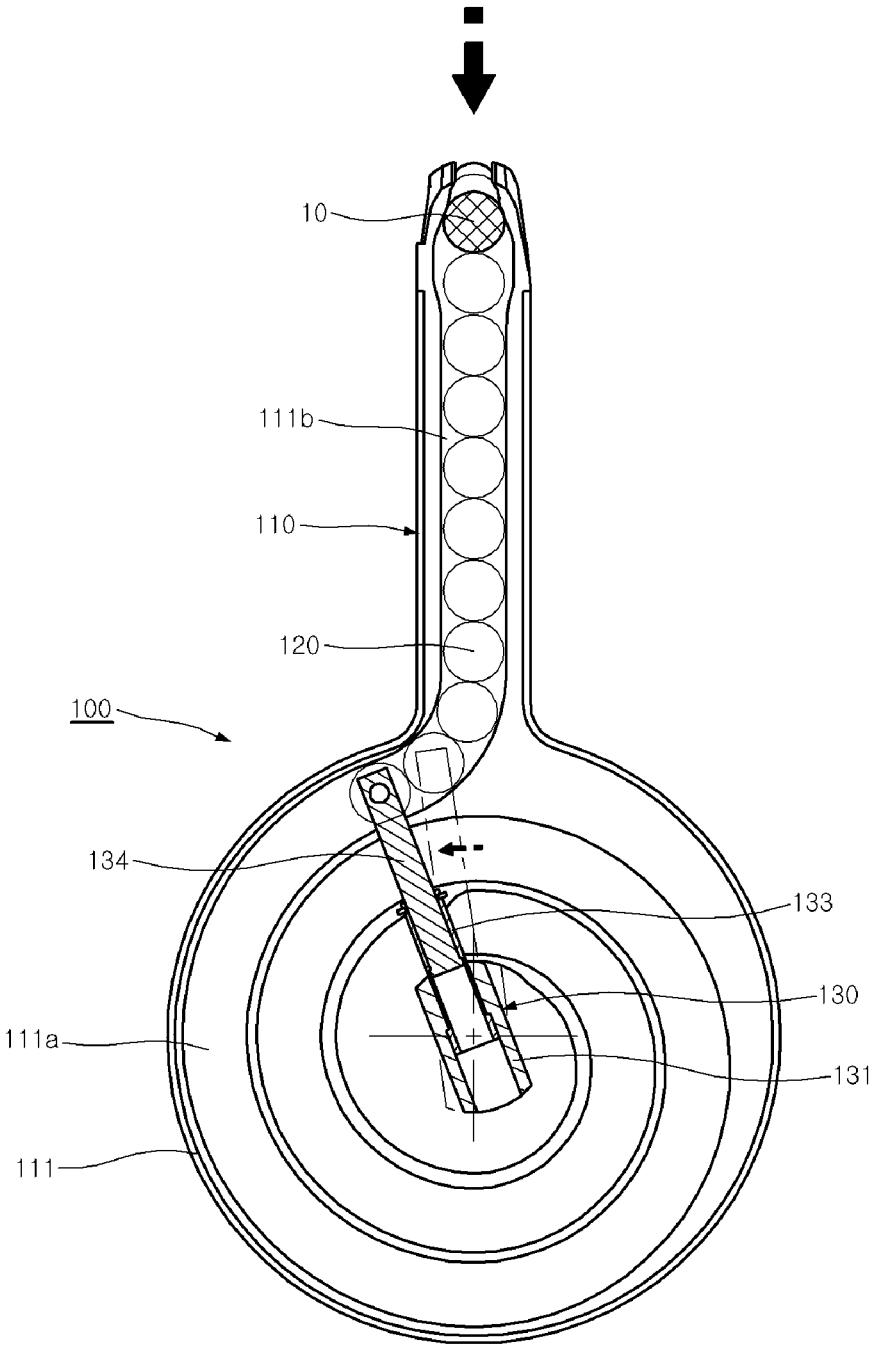
Figure 7:
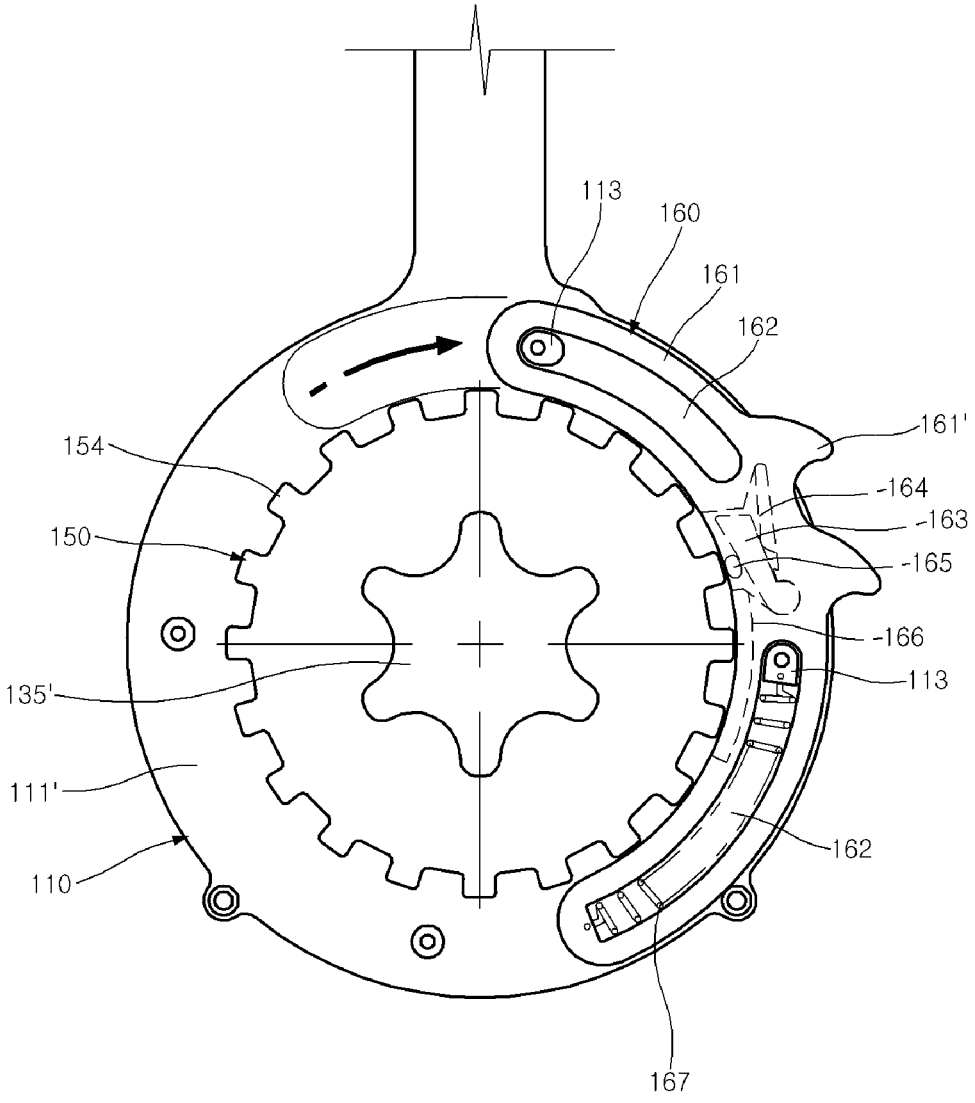
Figure 8:
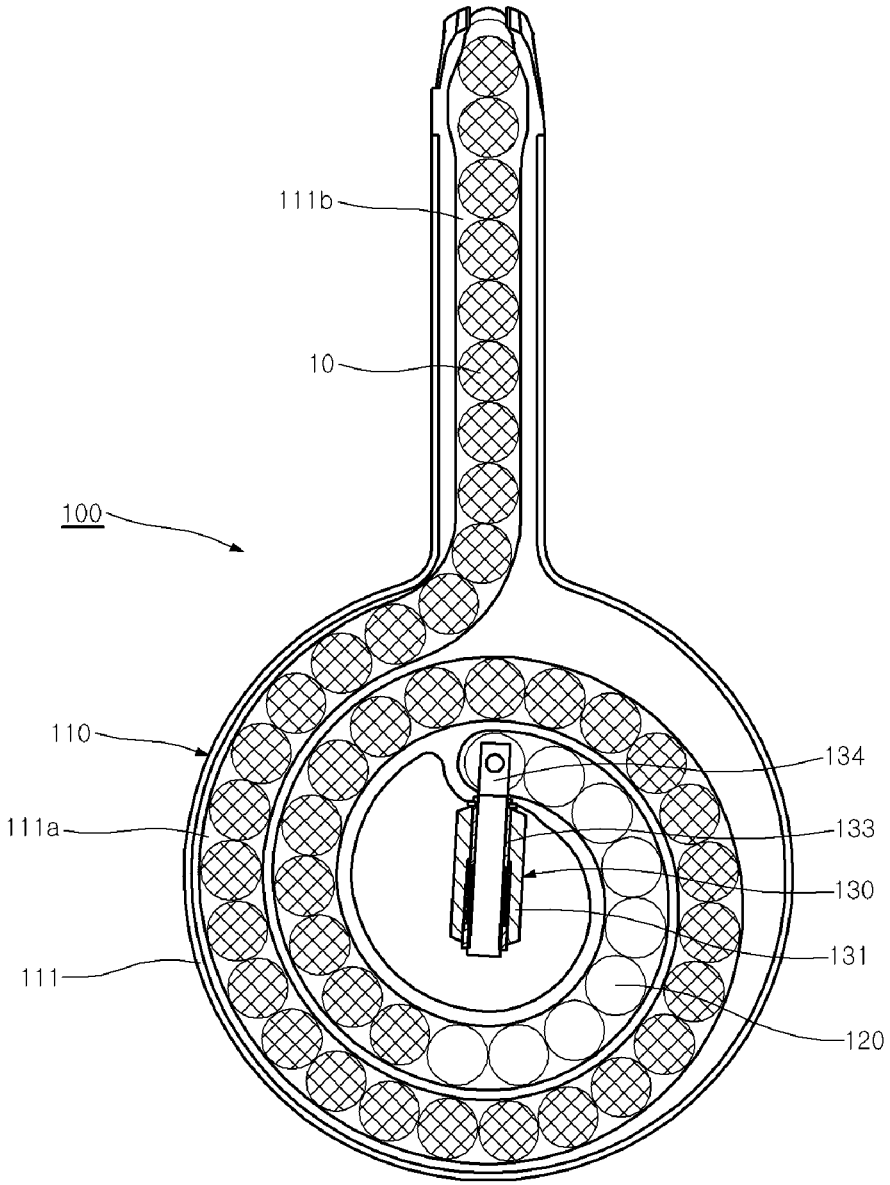

Hereinbelow, the present invention will be described in detail with reference to the accompanying drawings. FIG. 1 is an exploded perspective view of a drum-type magazine of the present invention. FIG. 2 is a sectional view of the drum-type magazine of the present invention. FIG. 3 is a view showing the internal structure of the drum-type magazine of the present invention. FIG. 4 is a view showing the rear structure of the drum-type magazine of the present invention.

The drum-type magazine 100 of the present invention includes: a drum unit 110 in which cartridges 10 are loaded in a spiral line; a plurality of imitation cartridges 120 installed in the drum unit 110; a cartridge guide unit 130 combined with the drum unit 110 and guiding the loading of cartridges 10 while being rotated by a tension control unit 150; a tension member 140 mounted to the outer surface of the drum unit 110 and elastically supporting the cartridge guide unit 130; the tension control unit 150 controlling the elasticity of the tension member 140; a cartridge loading unit 160 that is mounted to the outer surface of the drum unit 110 and rotates the cartridge guide unit 130 by an operation of a cartridge loading lever 161, and forms a cartridge loading space in the drum unit 110 for being loaded with cartridges 10, in which the cartridge loading lever 161 is immediately returned to an initial position thereof by a second spring 167; and a protective cover unit 170 mounted to the outer surface of the drum unit 110 and protecting both the tension control unit 150 and the cartridge loading unit 160. The above-mentioned elements of the magazine 100 will be described in detail as follows.

The drum unit 110 includes first and second casings 111 and 111' that are combined with each other, with a spiral space 111*a* formed between first and second casings 111 and 111'. An outlet 111*b* is formed in the drum unit 110, so that cartridges 10 can be ejected from the drum unit 110 to the outside via the outlet 111*b*. The first and second casings 111 and 111' have respective locking through holes 112 and 112' through which the cartridge guide unit 130 is fastened inside the drum unit 110. Guide protrusions 113 protrude outward from the outer surface of the second casing 111'. Here, the guide protrusions 113 function to hold the protective cover unit 170 and to guide the movement of the cartridge loading unit 160, as will be described later herein.

Here, the locking through hole 112 of the first casing 111 may have a rectangular shape.

The cartridge guide unit 130 includes: a main body 131 having a stop step 131*a* therein; a locking shaft 132 having rectangular bar parts 132*a* and 132*b* extending outward from opposite sides of the main body 131; a guide member 133 movably fitted in the main body 131, with an outside step 133*a* formed on an outer surface of the guide member 133 and an inside step 133*b* formed on an inner surface of the guide member 133; a holding member 134 movably fitted in the guide member 133, with a stop protrusion 134*a* formed on an upper end of the holding member 134 and a holding hole 134*b* formed in a lower end of the holding member 134 and holding the imitation cartridges 120; and locking caps 135 and 135' fastened to the locking shaft 132 on opposite side surfaces of the drum unit 110.

The tension control unit 150 includes: a toothed body 151 having a rectangular through hole 151' with which the cartridge guide unit 130 is combined; a locking slit 152 formed in a central portion of the toothed body 151 and combined with an inside end 140' of the tension member 140; a rib 153 formed on an outer portion of the toothed body 151 and combined with an outside end 140" of the tension member 140; and teeth 154 formed on an outer circumferential surface of the toothed body 151.

The cartridge loading unit 160 includes: the cartridge loading lever 161 mounted to the outer surface of the drum unit 110 and rotated about the center of the drum unit 110; longitudinal guide holes 162 formed in the cartridge loading lever 161 and guided by the respective guide protrusions 113 of the drum unit 110 during a rotation of the cartridge loading lever 161 about the center of the drum unit 110; a rotation piece 163 combined with the cartridge loading lever 161 and operated to rotate the tension control unit 140 when loading the drum unit 110 with a cartridge 10; a first spring 164 elastically returning the rotation piece 163 to an initial position thereof; a forcible rotating protrusion 165 protruding from a side of the drum unit 110 and forcibly rotating the rotation piece 163 when the cartridge loading lever 161 is being returned to the initial position thereof; a guide recess 166 receiving and guiding the forcible rotating protrusion 165 during a rotation of the cartridge loading lever 161; and the second spring 167 held between the terminal end of one of the longitudinal guide holes 162 and an associated one of the guide protrusions and elastically returning the cartridge loading lever 161 to the initial position thereof when the drum unit 110 has been completely loaded with a cartridge 10 by a rotation of the cartridge loading lever 161 under the guide of the guide protrusions 113 engaged with the respective longitudinal guide holes 162.

The protective cover unit 170 includes: a cover 171 that is mounted to the outer surface of the drum unit 110 and protects both the tension control unit 140 and the cartridge loading unit 160; and fastening members 172 that fasten the cover 171 to the guide protrusions 113 of the drum unit 110.

Here, the protective cover unit 170 may be configured to be partially open at a portion corresponding to a radius of gyration of the cartridge loading unit 160.

Hereinbelow, the process of assembling the magazine of the present invention will be described in detail.

First, as shown in FIGS. 2 to 4, the cartridge guide unit 130 is placed between the first and second casings 111 and 111' of the drum unit 110, and the guide member 133 and the holding member 134 are sequentially assembled with the main body 131 of the cartridge guide unit 130. Thereafter, a set of imitation cartridges 120 is installed by locking the set of imitation cartridges 120 to the holding hole 134' of the holding member 134 that protrudes downward from the lower end of the main body 131.

Further, the set of imitation cartridges 120 is placed inside the drum unit 110 while combining the locking shaft 132 of the cartridge guide unit 130 with both the first and second casings 111 and 111'. Here, when the first and second casings 111 and 111' are combined with each other, the drum unit 110 is formed, with the imitation cartridges 120 sequentially placed in the outlet 111*b* of the drum unit 110.

Thereafter, both the tension member 140 and the tension control unit 150 are mounted to the outer surface of the second casing 111' of the drum unit 110. Here, the inside end 140' of the tension member 140 is engaged with the locking slit 152 of the tension control unit 150, and the outside end 140" of the tension member 140 is engaged with the rib 153 formed on the outer portion of the toothed body 151. Thereafter, the toothed body 151 of the tension control unit 150 is pushed onto the outer surface of the second casing 111' such that the toothed body 151 can come into close contact with the outer surface of the second casing 111'.

Further, the tension control unit 150 is combined with the rectangular bar part 132*b* formed on the locking shaft 132 of the cartridge guide unit 130. Here, the rectangular through hole 151' of the tension control unit 150 is fitted over the rectangular bar part 132*b* of the locking shaft 132, so that the tension control unit 150 can be rotated along with the locking shaft 132 of the cartridge guide unit 130.

Thereafter, the locking cap 135' is fastened to the locking shaft 132 at a location outside the tension control unit 150, and the locking cap 135 is fastened to the locking shaft 132 on the outer surface of the first casing 111, thereby firmly holding the cartridge guide unit 130 at opposite sides of the cartridge guide unit 130.

Further, the rotation piece 163 is rotatably engaged with a rotation guide groove 163' formed in the cartridge loading lever 161 of the cartridge loading unit 160, and the first spring 164 is combined with the holding step 164' formed on the cartridge loading lever 161.

Thereafter, when combining the cartridge loading lever 161 with the guide protrusions 113 formed on the outer surface of the drum unit 110 after placing the longitudinal guide holes 162 of the cartridge loading lever 161 over the respective guide protrusions 113, the cartridge loading lever 161 is brought into close contact with the outer surface of the drum unit 110.

In the above state, the rotation piece 163 is forcibly rotated by the forcible rotating protrusion 165, thereby compressing the first spring 164 and bringing the tension control unit 150 into a rotatable state.

Here, a first end of the second spring 167 is held by the guide protrusion 113 engaged with one of the longitudinal guide holes 162, while a second end of the second spring 167 is held by the terminal end of the longitudinal guide hole 162.

After the cartridge loading unit 160 is completely assembled with the drum unit 110, both the tension control unit 150 and the cartridge loading unit 160 are covered with the protective cover unit 170 such that both the tension control unit 150 and the cartridge loading unit 160 can be hidden from the outside.

Here, the protective cover unit 170 is mounted to the drum unit 110 using the fastening members 172, such as locking screws or locking bolts, while placing the cover 171 of the protective cover unit 170 on the outer surface of the drum unit 110 in such a way that the open portion of the cover 171 is located at a position corresponding to the cartridge loading unit 160 so as to allow a user to rotate the handle 161' of the cartridge loading lever 161 with a finger.

Hereinbelow, the operation of the above-mentioned drum-type magazine of the present invention will be described.

First, as shown in FIGS. 5 to 8, when it is required to load the drum unit 110 with a cartridge 10, a user rotates the handle 161' of the cartridge loading lever 161 upward with a finger, so that the cartridge loading lever 161 is rotated counterclockwise about the center of the drum unit 110.

In the above state, the longitudinal guide holes 162 of the cartridge loading unit 160 are rotated counterclockwise under the guide of the respective guide protrusions 113 and, at the same time, the rotation piece 163 is removed from the forcible rotating protrusion 165 and comes into engagement with one of the teeth 154 of the tension control unit 150. In the above state, the forcible rotating protrusion 165 is placed in the guide recess 166.

Here, due to the above-mentioned counterclockwise rotation of the cartridge loading lever 161, the second spring 167 held between one of the guide protrusions 113 and the terminal end of an associated one of the longitudinal guide holes 162 is compressed.

When rotating the cartridge loading lever 161 as described above, the rotation piece 163 engaged with the teeth 154 of the toothed body 151 of the tension control unit 150 rotates the toothed body 151. Due to the rotation of the toothed body 151, the cartridge guide unit 130 inside the drum unit 110 is also rotated. Thus, a cartridge loading space for being loaded with cartridges 10 is formed in the spiral space 111*a* of the drum unit 110.

In the above state, the cartridge guide unit 130 is rotated with the length thereof increased to the maximum length due to the imitation cartridges 120 sequentially placed in the outlet 111*b* of the drum unit 110. Further, the outside step 133*a* of the guide member 133 fitted in the main body 131 is stopped by the stop step 131*a* of the main body 131, and the stop protrusion 134*a* of the holding member 134 fitted in the guide member 133 is stopped by the inside step 133*b* formed in the guide member 133, so that the total length of the guide member 133 and the holding member 134 is increased.

When a cartridge loading standby position of the magazine is achieved, the user releases the handle 161' of the cartridge loading lever 161 that has been rotated counterclockwise. Accordingly, the cartridge loading lever 161 is elastically rotated clockwise under the guide of the guide protrusions 113 by the restoring force of the compressed second spring 167 until the cartridge loading lever 161 is completely returned to the initial position thereof. In the above state, the rotation piece 163 that has been engaged with one of the teeth 154 comes into contact with the forcible rotating protrusion 165, so that the rotation piece 163 is rotated and is removed from the tooth 154. In the above state, the rotation piece 163 removed from the teeth 154 compresses the first spring 164.

When the cartridge loading lever 161 of the cartridge loading unit 160 is completely returned to the initial position thereof as described above, the user can load the cartridge loading space formed inside the drum unit 110 with a cartridge 10.

The user can continuously load the cartridge loading space of the drum unit 110 with cartridges 10 while repeating the above-mentioned process of actuating the cartridge loading lever 161 of the cartridge loading unit 160.

Figure 9:
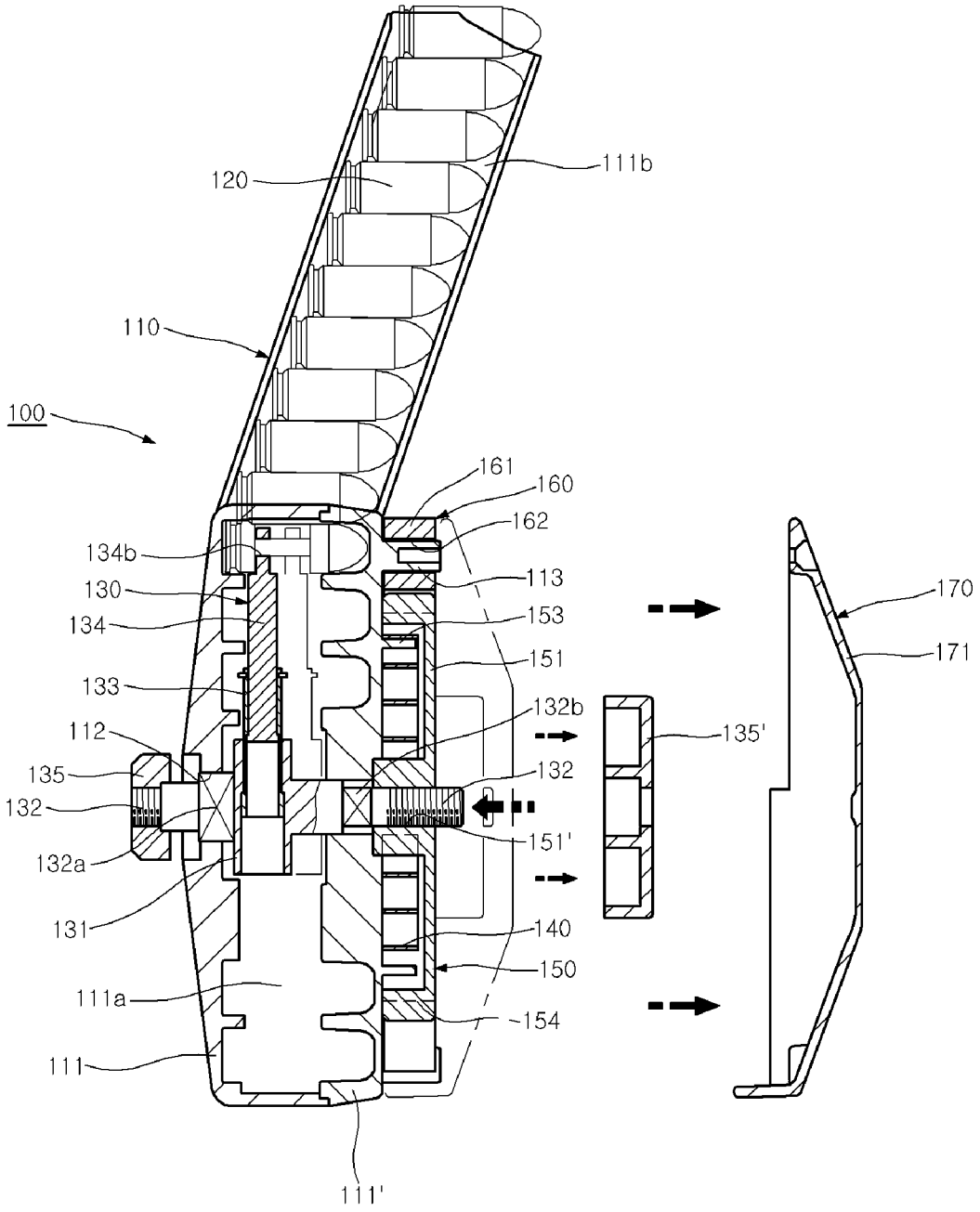
FIGS. 9 to 11 are views showing the operation of a tension control unit of the present invention.
Figure 10:
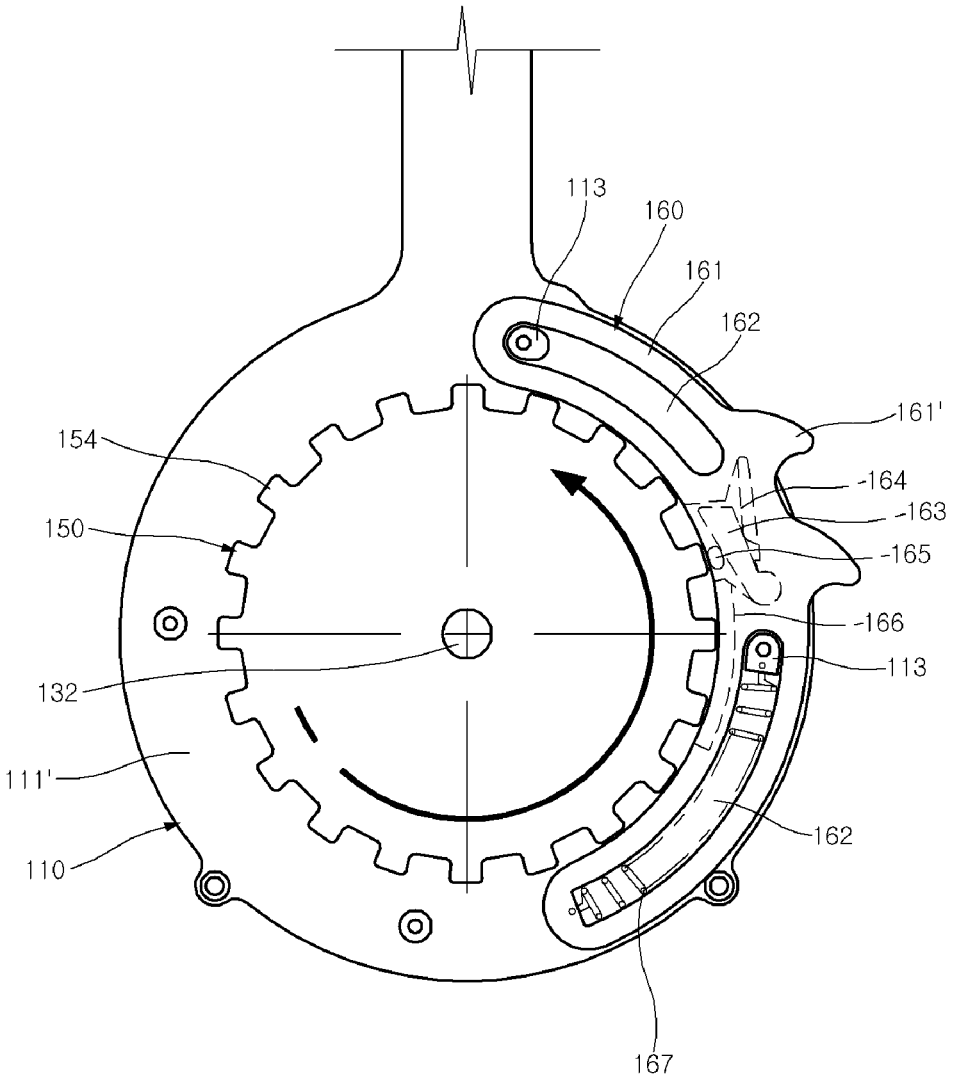
Figure 11:
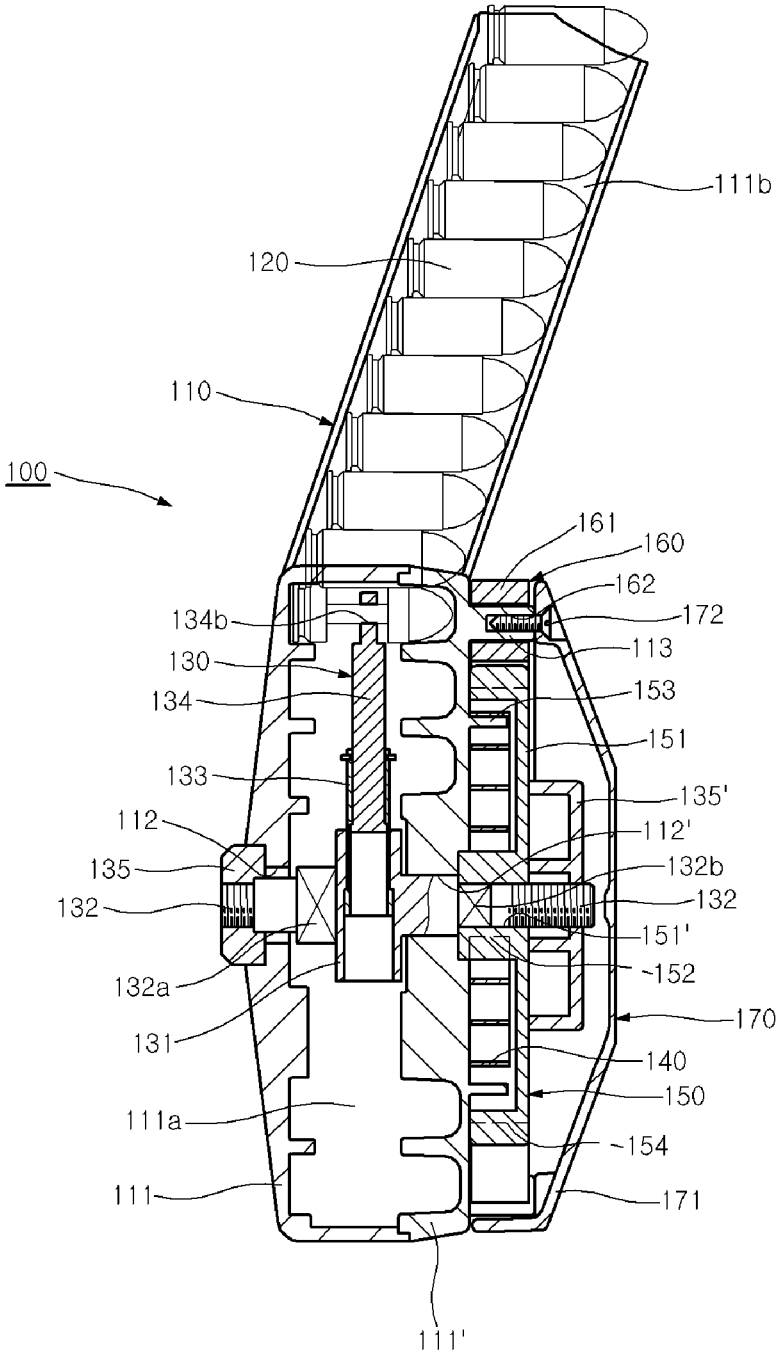

Further, as shown in FIGS. 9 to 11, when the elasticity of the tension member 140 is reduced due to repeated loading of cartridges 10 over a lengthy period of time, the elasticity of the tension member 140 can be controlled to be increased by operating the tension control unit 150. To control the elasticity of the tension member 140, the cover 171 is removed from the drum unit 110 and the locking cap 135' that has been fastened to the locking shaft 132 of the cartridge guide unit 130 is removed from the locking shaft 132 by rotating the locking cap 135'.

Thereafter, the locking shaft 132 of the cartridge guide unit 130 is pressed toward the first casing 110 at a position outside the tension control unit 150, so that the rectangular bar part 132*b* of the locking shaft 132 is removed from the rectangular through hole 151' of the tension control unit 150 and the rectangular bar part 132*a* of the locking shaft 132 is inserted into the locking through hole 112 of the first casing 111. Thus, the cartridge guide unit 130 is brought into a fixed state, while the tension control unit 150 is brought into a rotatable state.

When rotating the cartridge loading lever 161 of the cartridge loading unit 160 upward while pressing the locking shaft 132 as described above, the rotation piece 163 comes into close contact with the teeth 154 of the tension control unit 150.

When rotating the toothed body 151 having the teeth 154 in a direction in which the tension member 140 can be tightened, the elasticity of the tension member 140 can be increased.

After controlling the elasticity of the tension member 140, the locking cap 135 exposed outside the first casing 111 is pressed in a direction toward the second casing 111', so that the rectangular bar part 132*a* is removed from the locking through hole 112 of the first casing 111 and, at the same time, the rectangular bar part 132*b* of the locking shaft 132 is inserted into the rectangular through hole 151' of the tension control unit 150.

Thereafter, the locking cap 135' is fastened to the locking shaft 132 protruding outside the tension control unit 150 such that the cartridge guide unit 130 and the tension control unit 150 can be rotated together. Thereafter, the cover 171 that functions to protect both the tension control unit 150 and the cartridge loading unit 160 is fastened to the outer surface of the drum unit 110 using the fastening members 172.

Although the preferred embodiments of the present invention have been disclosed for illustrative purposes, all terms and words used in the specification and appended claims should be interpreted as having a meaning that is consistent with their meaning in the context of the relevant art and the present disclosure, without being interpreted as those defined in commonly used dictionaries. Accordingly, those skilled in the art will appreciate that specific structural and functional descriptions of embodiments of the present invention disclosed herein are only for illustrative purposes of the preferred embodiments of the invention, and the present description is not intended to represent all of the technical spirit of the present invention. On the contrary, the present invention is intended to cover not only the exemplary embodiments, but also various alternatives, modifications, equivalents and other embodiments that may be included within the spirit and scope of the present invention as defined by the appended claims.

The invention claimed is:

1. A drum magazine, comprising: a drum unit having a space therein for being loaded with cartridges in a spiral line; a plurality of imitation cartridges installed in the drum unit; a cartridge guide unit combined with the drum unit and guiding a loading of cartridges while being rotated by an operation of a tension control unit; a tension member mounted to an outer surface of the drum unit and elastically supporting the cartridge guide unit; the tension control unit controlling elasticity of the tension member; a cartridge loading unit mounted to the outer surface of the drum unit and rotating the cartridge guide unit by an operation of a cartridge loading lever, wherein the cartridge loading lever is mounted on the drum unit, thereby forming a cartridge loading space in the drum unit for being loaded with cartridges, wherein the cartridge loading lever is immediately returned to an initial position thereof by a second spring; and a protective cover unit mounted to the outer surface of the drum unit and protecting both the tension control unit and the cartridge loading unit.

2. The drum magazine of claim 1, wherein the drum unit comprises: first and second casings combined with each other, with a spiral space formed between first and second casings and with an outlet formed in the drum unit so that cartridges can be ejected from the drum unit to an outside via the outlet; locking through holes formed in the first and second casings, respectively, so that the cartridge guide unit is fastened inside the drum unit through the locking through holes; and guide protrusions protruding outward from an outer surface of the second casing, the guide protrusions holding the protective cover unit and guiding a movement of the cartridge loading unit.

3. The drum magazine of claim 2, wherein the locking through hole of the first casing has a rectangular shape.

4. The drum magazine of claim 1, wherein the cartridge guide unit comprises: a main body having a stop step therein; a locking shaft having rectangular bar parts extending outward from opposite sides of the main body; a guide member movably fitted in the main body, with an outside step formed on an outer surface of the guide member and an inside step formed on an inner surface of the guide member; a holding member movably fitted in the guide member, with a stop protrusion formed on an upper end of the holding member and a holding hole formed in a lower end of the holding member and holding the imitation cartridges; and locking caps fastened to the locking shaft on opposite side surfaces of the drum unit.

5. The drum magazine of claim 1, wherein the tension control unit comprises: a toothed body having a rectangular through hole with which the cartridge guide unit is combined; a locking slit formed in a central portion of the toothed body and combined with an inside end of the tension member; a rib formed on an outer portion of the toothed body and combined with an outside end of the tension member; and teeth formed on an outer circumferential surface of the toothed body.

6. The drum magazine of claim 1, wherein the cartridge loading unit comprises: the cartridge loading lever mounted to the outer surface of the drum unit and rotated about a center of the drum unit; longitudinal guide holes formed in the cartridge loading lever and guided by respective guide protrusions of the drum unit during a rotation of the cartridge loading lever about the center of the drum unit; a rotation piece combined with the cartridge loading lever and operated to rotate the tension control unit when loading the drum unit with a cartridge; a first spring elastically returning the rotation piece to an initial position thereof; a forcible rotating protrusion protruding from a side of the drum unit and forcibly rotating the rotation piece when the cartridge loading lever is being returned to the initial position thereof; a guide recess receiving and guiding the forcible rotating protrusion during a rotation of the cartridge loading lever; and the second spring held between a terminal end of one of the longitudinal guide holes and an associated one of the guide protrusions and returning the cartridge loading lever to the initial position thereof when the drum unit has been completely loaded with a cartridge by a rotation of the cartridge loading lever.

7. The drum magazine of claim 1, wherein the protective cover unit comprises: a cover mounted to the outer surface of the drum unit and protecting both the tension control unit and the cartridge 25 loading unit; and a fastening member fastening the cover to the drum unit.

8. The drum magazine of claim 7, wherein the protective cover unit is partially open at a portion corresponding to a radius of gyration of the cartridge loading unit.

* * * * *